US009340989B2

(12) United States Patent
Tudor

(10) Patent No.: US 9,340,989 B2
(45) Date of Patent: May 17, 2016

(54) LIGHTWEIGHT INSULATING SPA COVER

(76) Inventor: Jess E. Tudor, Medford, OR (US)

( * ) Notice: Subject to any disclaimer, the term of this patent is extended or adjusted under 35 U.S.C. 154(b) by 722 days.

(21) Appl. No.: 13/397,659

(22) Filed: Feb. 15, 2012

(65) Prior Publication Data

US 2012/0210508 A1 Aug. 23, 2012

Related U.S. Application Data

(60) Provisional application No. 61/463,562, filed on Feb. 19, 2011, provisional application No. 61/575,595, filed on Aug. 24, 2011.

(51) Int. Cl.
*E04H 4/00* (2006.01)
*E04H 4/10* (2006.01)

(52) U.S. Cl.
CPC ..... *E04H 4/103* (2013.01); *E04H 4/108* (2013.01)

(58) Field of Classification Search
USPC ..... 4/498, 503, 508
See application file for complete search history.

(56) References Cited

U.S. PATENT DOCUMENTS

| | | | | |
|---|---|---|---|---|
| 6,112,340 | A * | 9/2000 | Ziebert et al. | 4/498 |
| 7,308,722 | B2 * | 12/2007 | Koren | 4/498 |
| 2005/0055760 | A1 * | 3/2005 | Sutton et al. | 4/498 |
| 2005/0193484 | A1 * | 9/2005 | Procida | 4/498 |
| 2009/0056008 | A1 * | 3/2009 | Rosene et al. | 4/498 |
| 2011/0088157 | A1 * | 4/2011 | Young | 4/498 |

* cited by examiner

*Primary Examiner* — Lauren Crane
(74) *Attorney, Agent, or Firm* — Richard Esty Peterson

(57) ABSTRACT

A lightweight insulating spa cover for a heated spa with an open top, the spa cover constructed with a substantially rigid perimeter frame with a plurality of cross supports in the form of tension bands that encompass the frame in a crisscross pattern to form a support for an outer casing that encases the frame with the outer casing being fabricated of a breathable weatherproof fabric that is stretched over a layer of reflective bubble wrap material that provides a cushion and added insulation for the hollow lightweight cover.

15 Claims, 4 Drawing Sheets

LIGHTWEIGHT INSULATING SPA COVER

RELATED PATENT INFORMATION

This application relies on the priority dates of U.S. Provisional Application Ser. No. 61/463,562, filed Feb. 19, 2011 and U.S. Provisional Application Ser. No. 61/575,595, filed Aug. 23, 2011, both entitled, Lightweight Insulating Spa Cover.

This invention relates to insulating covers for spas and the like. The invention relates in particular to a hinged spa cover that is hollow and preferably includes the hinge system and lift system of my U.S. Pat. Nos. 6,634,036, 6,938,281 and 7,752,685, incorporated herein by reference.

BACKGROUND OF THE INVENTION

Spas, including hot tubs and the like, that contain heated water can use a substantial amount of power. Whether electric or gas, the thermal energy required to achieve and maintain an optimum temperature can be considerable. The typical spa cover is fabricated from an expanded polystyrene core encased in a water-impervious vinyl sheath. The problem with this design, is that within a remarkably short time the expanded polystyrene core becomes impregnated with water, typically from condensing vapors from the heated water in the spa. The thermal insulating properties of the spa cover diminish and the power required to maintain temperature in the spa water dramatically increases.

Many of the deficiencies in conventional hinged spa covers that utilize a crossbar lift mechanism in which the two segments of the hinged cover are folded over a support tube, have been eliminated by the thermally efficient designs found in my patents cited above and incorporated herein by reference. These designs eliminate the chimney effect for thermal losses between the folding segments of the spa cover, which are spaced apart at the hinge to accommodate the crossbar. However, the gradual degradation of the insulating properties of the expanded polystyrene (EPS) as it absorbs water becomes a significant factor in the thermal efficiency of the spa system.

In addition to maintaining a flat line thermal efficiency, the present designs eliminate the use of 14 cubic feet of EPS foam and the annoyance of a spa cover gradually becoming heavier and more of a chore to remove and replace, thereby lessening the enjoyment of the spa system.

SUMMARY OF THE INVENTION

The lightweight insulating spa cover of this invention is a hollow, bi-folding or hinged spa cover designed to eliminate water absorption. Preferably the cover is adaptable for use with a lift mechanism to assist in the removal and storage of the cover during use of the spa and replacement of the cover during the typically longer periods of non-use. The invented hollow spa cover has a substantially ridged frame for each half segment that is inserted into a breathable, water repellant outer skin. The half segments of the rigid frame are each assembled from two quarter-segments that are convenient for shipment. Each quarter-segment is fabricated from a rigid perimeter frame with tensioned cross bands. The quarter-segments are enveloped in poly-coated metallic bubble wrap that forms an unsealed casing and cushioned undersurface for the breathable outer skin.

The tensioned banding of each perimeter frame provides a structurally sound cover when the quarter-segments are securely interconnected as half-segments and the half-segments are hingedly interconnected by interconnecting the outer skin to form a lightweight cover that safely spans the open top of the spa.

It has been found that the hollow airspace within the casing can have improved thermal efficiency when the internal gas has minimal movement. The methods of minimizing convection currents can be conveniently be accomplished by large-bubble, bubble wrap used for lightweight packing and gas-filled pillow packs. The readily available materials can be used separately, or in combination. Typically bubble wrap is filled with air, but gas-filled pillow packs can be custom filled at the air frame cover fabrication site with a variety of different gases or gas mixtures that can improve performance.

These and other features and methods are set forth in greater detail in the Detailed Description of the Preferred Embodiments that follow. It is to be understood that the disclosure of the preferred embodiments does not limit the scope of the invention as defined in the claims.

DETAILED DESCRIPTION OF THE PREFERRED EMBODIMENT

Figure 2:
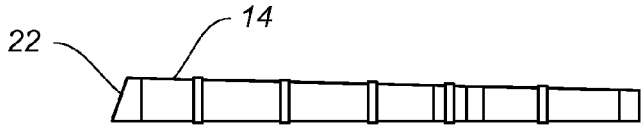
FIG. 2 is a side elevational view of the perimeter frame structure of one of the four quarter-segments of the hinged spa cover of FIG. 1 with skin and insulating padding removed to expose tension bands.
Figure 1:
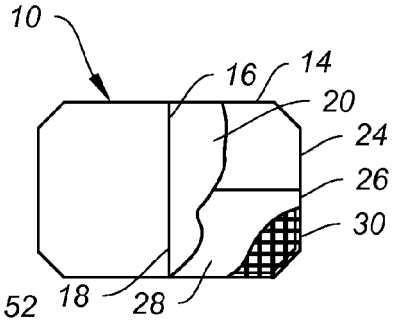
FIG. 1 is a plan view of a hinged spa cover with one half-segment of the cover of this invention encased in an outer skin and the other half-segment exposed with the two, coupled quarter-segments.

The lightweight insulating spa cover of this invention is shown in the top view of FIG. 1 and identified generally by the reference numeral 10. The spa cover 10 is preferably of the hinged type with two primary half-segments 12 and 14 that are interconnected by a hinge 16 that is formed by a conventional seam 18 in an outer casing or skin 20 that is preferably of a design described in my U.S. Pat. No. 7,752,685. This design allows the inclined ends 22 of the half-segments, as shown in the side elevational view of one of the segments to butt together when the spa cover lies flat on the top of a spa (not shown) thereby eliminating the chimney effect for thermal losses in the typical hinged spa cover that utilizes a conventional cross member lift mechanism.

The spa cover skin 20 is fabricated of a breathable weatherproof material such as a gas permeable, water repellant cloth/vinyl that encases the two half-segments upon assembly. The breathable skin 20 allows off-gassing of water vapor that accumulates within the tapered half-segments when the spa cover 10 covers the heated water of a spa.

The half-segments 12 and 14 are each formed by two quarter-segments 24 and 26 (two visible in FIG. 1) that are covered by a poly-coated metallic bubble wrap layer 28. The bubble wrap layer 28 provides both a cushion and added insulation over a perimeter frame structure 30, shown in part in FIG. 1 and in detail in FIGS. 2-5.

The perimeter frame structure 30 is constructed with a rigid perimeter frame 34 with a series of tension bands 36 that are arranged in a crisscross pattern as show to provide a flexible support for the bubble wrap layer 28. The tension bands 36 are ½ inch wide polyester banding straps that surround the frame and use a calibrated banding tool to apply equal tension to each band. The bubble wrap layer 28 is taped to each quarter-segment 24 and 26 in a manner that covers the outer edges, but exposes the abutting edges 38 of hinge members 40 of the perimeter frame 34.

The bubble wrap layer 28 covers, but does not seal the internal space in each quarter segment 24 and 26 to allow escape of any internal water vapor through the outer skin 20.

Figure 8:
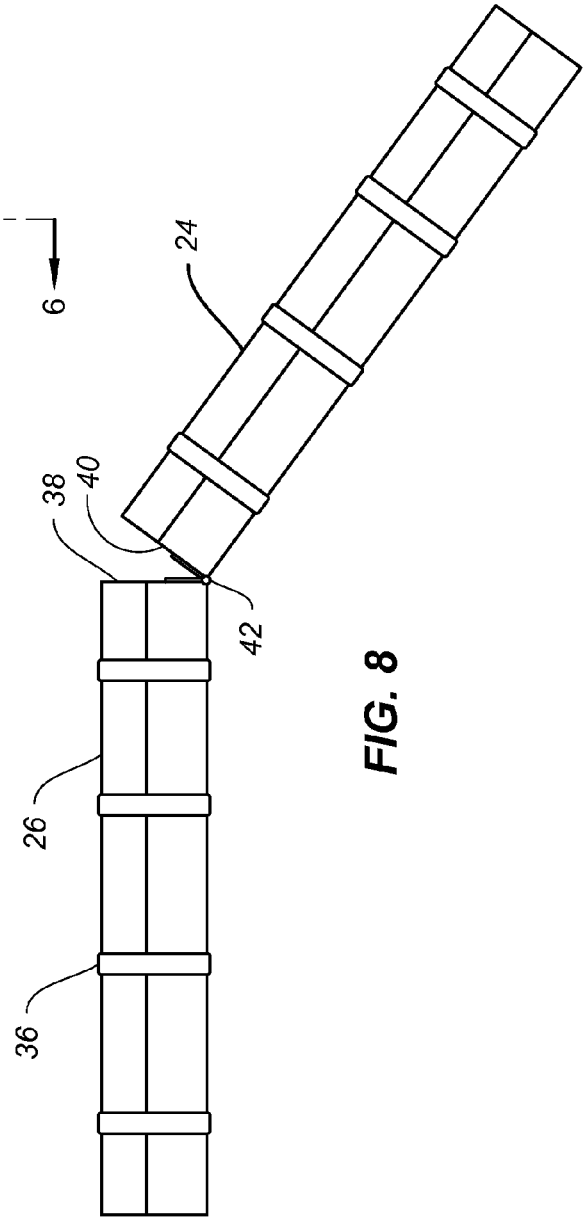
FIG. 8 is a side elevational view of two quarter-segments connected by hinges being unfolded before being secured into a flat rigid half-segment.

As shown in FIG. 8, the abutting edges 38 of the hinge members 40 of the perimeter frame 34 have hinge elements 42 which are interconnected to allow the quarter-segments to be folded upon one another for compact shipment.

Figure 4:
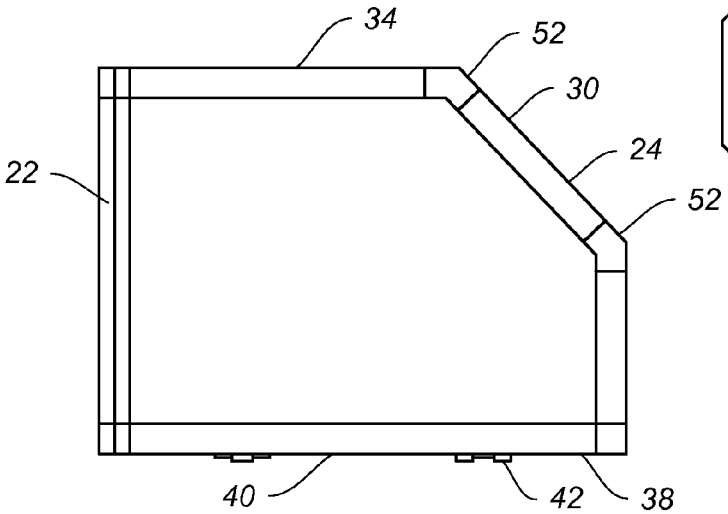
FIG. 4 is a top view of a complementary quarter-segment to the quarter-segment of FIG. 3 with tension bands removed to show the perimeter frame structure of the quarter-segments.
Figure 7:
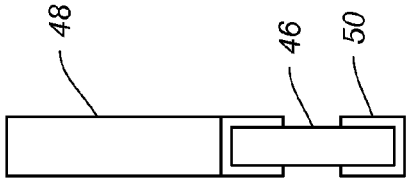
FIG. 7 is a cross-sectional view of the frame element of FIG. 6 taken on the lines 6-6 in FIG. 6.
Figure 6:
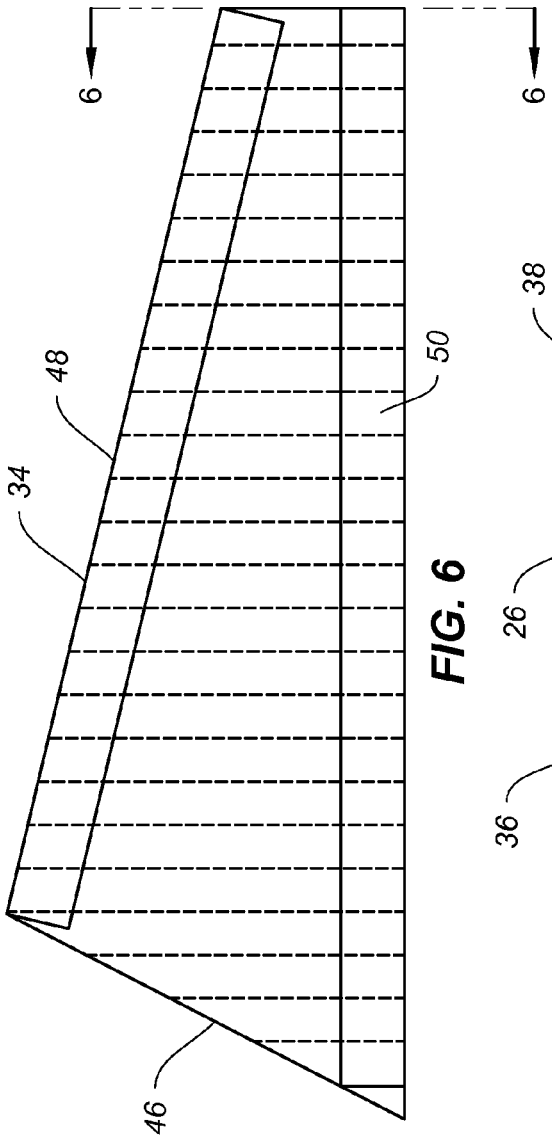
FIG. 6 is an enlarged side elevational view of a frame element of the perimeter frame structure of FIG. 4.

Referring now to FIGS. 6 and 7, a preferred structure for the members of the perimeter frame 34 is illustrated. In the side view of FIG. 6, a fluted vinyl vertical member 46 is cut to shape from ⅜ inch thick fluted vinyl board and capped with an aluminum channel 48 on the top edge and an aluminum channel 50 on the bottom edge as shown in the cross-sectional view of FIG. 7. The slope of the top edge is exaggerated to illustrate the conventional taper of each of the two half-segments 12 and 14 from the center hinge 16. The remaining members of the perimeter frame 34 are similarly constructed and interconnected by couplers 52 as shown in FIG. 4.

Figure 3:
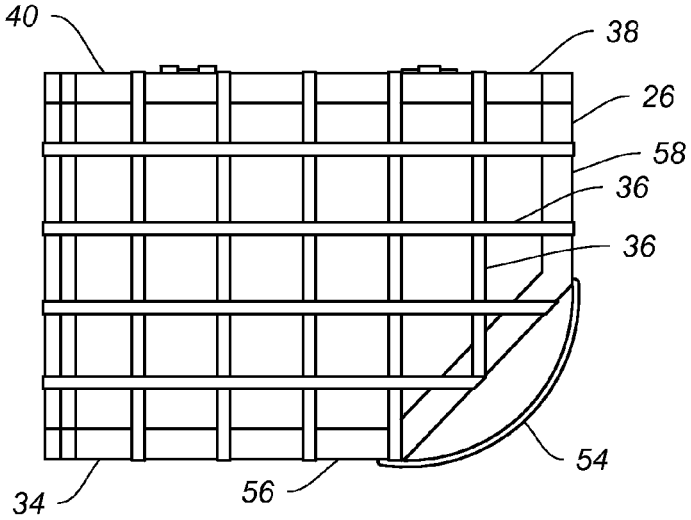
FIG. 3 is a top view of the perimeter frame structure of the quarter-segment of FIG. 2 with a tension bands shown arranged in a crisscross pattern around the perimeter frame structure.
Figure 5:
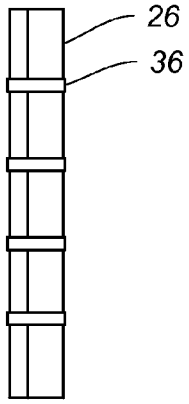
FIG. 5 is an end elevational view of the quarter-segment of FIG. 3.

Additionally, if rounded corners are preferred, a band or strap 54 can be secured to frame members 56 and 58 as shown in FIG. 3.

It is contemplated that for ease of shipment, the two pairs of interconnected quarter-segments are folded and stacked and shipped with the outer skin. Assembly is accomplished by unfolding each quarter-segment and securing the edges 38 of the hinge members 40 together with screws or the like. Each half-segment is slipped into a separate compartment of the outer skin 20 and the skin enclosed with a zipper or other conventional enclosure means common to upholstery and the like.

In addition to providing a lightweight thermally efficient cover that has an extended lifetime without thermal degradation, the hollow environmentally friendly cover eliminates approximately 14 cubic feet of expanded polystyrene foam of a conventional cover that is ultimately destine for landfill.

Figure 9:
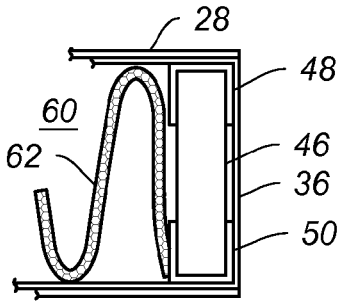
FIG. 9 is a cross-sectional view of the frame element of FIG. 7 with an air chamber divided by a bubble wrap wave.

The thermal efficiency of the hollow interior of each air filled quarter-segment can be improved by reducing movement of the air within the chamber 60 formed by the bubble wrap layer 28 and the perimeter frame 34. The method of reducing gas movement can vary from simply dividing the chamber into smaller compartments, for example, by light weight packing materials such as ordinary bubble wrap 62 inserted in a wave form as shown in the cross-sectional view of FIG. 9.

Figure 11:
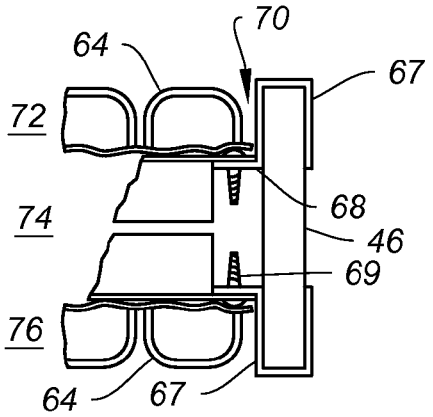
FIG. 11 is a partial cross-sectional view of the perimeter frame of FIG. 10 with bubble wrap layers.
Figure 10:
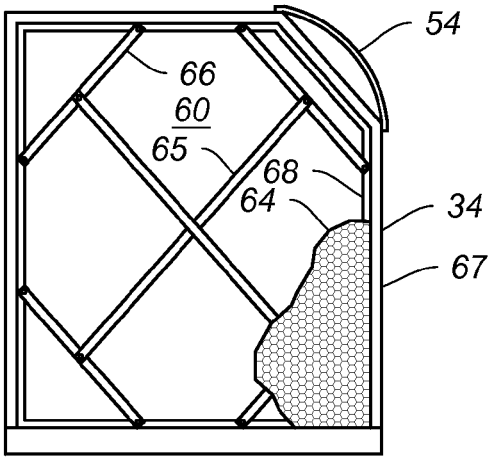
FIG. 10 is a top view of a modified perimeter frame with a large-bubble bubble wrap layer shown in part.

Alternately, as shown in FIGS. 10 and 11, large-bubble, bubble wrap 64 can be supported on polymer cross straps 65 attached to L-shaped corner braces 66 that are attached to the perimeter frame 34 having modified aluminum capping channels 67 with a projecting lip 68. The corner braces 66 are connected to the lip 68 of the capping channels 67 by fasteners to provide a lowered central section 70 and thereby form three zones 72, 74 and 76 that are separated into divided compartments for reduced air movement.

Figure 12:
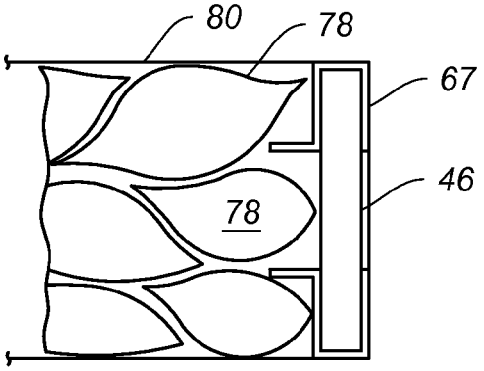
FIG. 12 is a partial cross-sectional view of a perimeter frame with a chamber filled with packing pillows.

A simple but unique method of reducing gas convection in the chamber 60 is to loosely fill the chamber with gas-filled packing pillows 78 as shown in FIG. 12. The packing pillows 78 are typically filled with dry air, but a preferred method is to fill the pillows with a relatively inert, inexpensive gas such as nitrogen. If packing pillows 78 are used alone, the perimeter frame should be wrapped with thin polymer wrapping sheet 80 typically used in shipping. The polymer wrapping sheet 80 adds little weight and provides a skin between which the gas-filled packing pillows 78 can be inserted and retained before the tension straps art installed around the frame.

Figure 13:
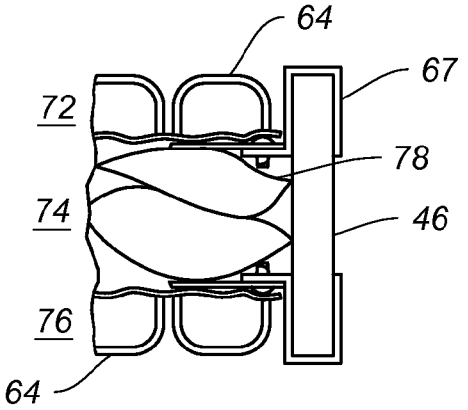
FIG. 13 is a partial cross-sectional view of the perimeter frame of FIG. 10 with bubble wrap layers and a packing pillow layer.

The method of reducing gas convection in the chamber using a combination of different gas-filled polymer materials is advantageous to form discrete layers or compartments that minimize air movement yet allow breathing to expel water vapor within the outer casing or skin 20. As shown in FIG. 13, the assembly of FIG. 11 can include a center zone 74 filled with packing pillows 78 as well as upper and lower zones 72 and 76 filled with large-bubble, bubble wrap 64.

Figure 14:
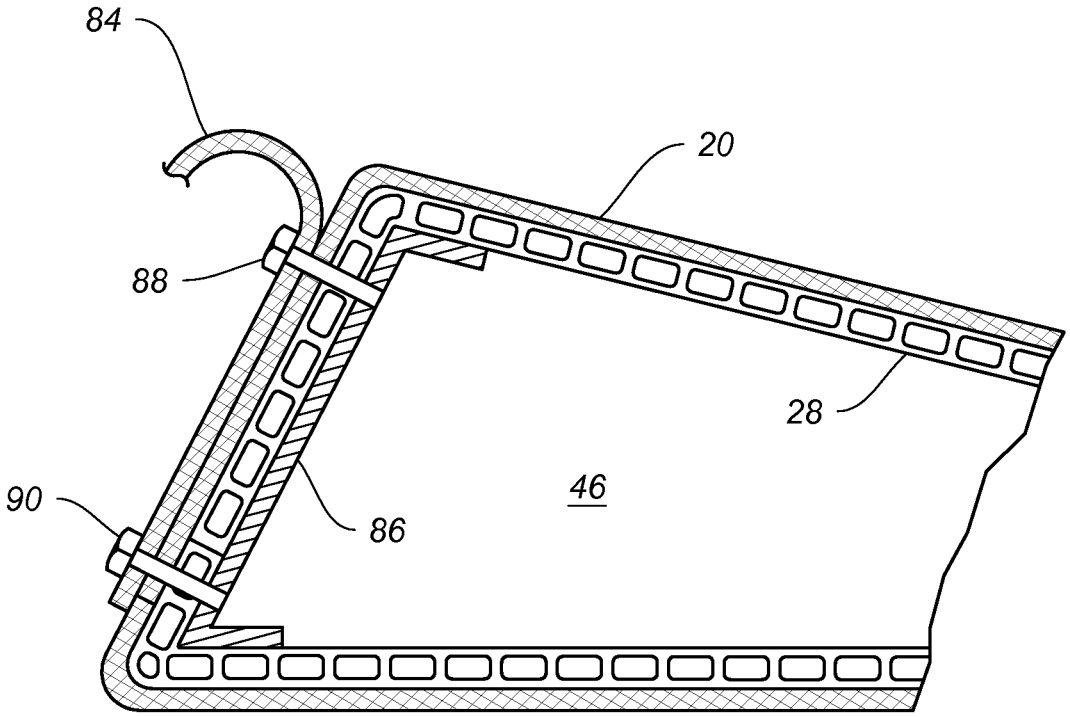
FIG. 14 is a partial cross-sectional view of the hinged portion of one half-segment with a bubble wrap outer layer covered by a fabric skin.

As shown in the cross-sectional view of FIG. 14, the inclined end 22 of one half-segment 14 abuts the complimentary half-segment 12 (not shown) by a hinge 16, which is preferably a fabric hinge 84. The fabric hinge 84 is attached to a plastic or metal end channel 86 by a series of screws 88 and 90 which are shown before tightening that will result in being recessed in the outer skin and the under layer of thin bubble wrap 28. It is to be understood that other techniques such as gluing, tacking, and stapling that are common to the upholstery industry may be used. In this manner the expensive zipper can be avoided. The finished product can have the fit and finish of tautly applied fabric which greatly enhances the aesthetic value compared to the zippered vinyl encasements other spa covers utilize. The use of the fabric cover method also provides reduced labor and equipment costs.

It is to be understood that many variations can be made to the methods described to achieve a foam-free cover with equal or better thermal characteristics than standard EPS foam filled spa covers at the beginning of their life. The thermal characteristics of the air frame covers will remain constant throughout their useful life, which should equal or exceed the life of the portable spa on which they are used.

The invention claimed is:

1. A lightweight insulating spa cover for a heated spa with an open top, the spa cover comprising:

a rigid perimeter frame structure;

a plurality of cross supports wherein the cross supports span the frame structure and are in tension, the cross supports having end portions connected to the frame structure, wherein the frame structure has a thickness and the cross supports and frame structure provide a topside support layer and an underside support layer, wherein the perimeter frame structure, the topside support layer and the underside support layer define a chamber between the topside support layer and the underside support layer.

2. The lightweight insulating spa cover of claim 1 wherein the topside support layer and the underside support layer include a breathable weatherproof material that encases the rigid perimeter frame structure and the plurality of cross supports.

3. The lightweight insulating spa cover of claim 1 wherein the topside support layer and the underside support layer include an outer casing that encases the frame structure and the cross supports.

4. The lightweight insulating spa cover of claim 1 wherein the cross supports are tension elements that wrap around the frame structure.

5. The lightweight insulating spa cover of claim 4 wherein the tension elements are flat tension bands.

6. The lightweight insulating spa cover of claim 5 wherein the tension bands encompass the frame structure to provide the topside support layer and the underside support layer.

7. The lightweight insulating spa cover of claim 6 wherein the tension bands are spaced apart and are arranged on the frame structure in a crisscross pattern.

8. The lightweight insulating spa cover of claim 7 wherein the topside support layer and the underside support layer in combination with an outer covering of a breathable waterproof material form an outer casing that encases the frame structure and the cross supports.

9. The lightweight insulating spa cover of claim 1 wherein the chamber is divided into separated compartments to minimize air movement within the chamber.

10. The lightweight insulating spa cover of claim 1 wherein the chamber is filled with gas-filled packets to minimize air movement within the chamber.

11. The lightweight insulating spa cover of claim 1 wherein the topside support layer and underside support layer support a bubble-wrap casing and an outer skin of a weather resistant breathable material.

12. The lightweight insulating spa cover of claim 11 wherein the outer skin of a weather resistant breathable material encases the perimeter frame structure, cross supports and bubble-wrap casing.

13. The lightweight insulating spa cover of claim 12 wherein the outer skin of a weather resistant breathable material encases the perimeter frame structure and cross supports in any one of conventional configurations of the spa cover.

14. The lightweight insulating spa cover of claim 3 wherein the perimeter frame structure and cross supports are configured in two modules, each with an outer casing wherein the two modules are interconnected by a hinge to form a hinged spa cover.

15. The lightweight insulating spa cover of claim 3 wherein the perimeter frame structure and cross supports are configured in four quarter modules, wherein two quarter modules are interconnectable into rigid half-segments and each half-segment is encased in a separate outer casing and the half segments are interconnected by a hinge to form a hinged spa cover.

* * * * *